US008511261B2

(12) United States Patent
Maruyama et al.

(10) Patent No.: US 8,511,261 B2
(45) Date of Patent: Aug. 20, 2013

(54) PISTON COOLING DEVICE

(75) Inventors: Shigenao Maruyama, Miyagi (JP); Atsuki Komiya, Miyagi (JP); Shuichi Moriya, Miyagi (JP); Morimasa Nagata, Saitama (JP); Seiji Kosaka, Saitama (JP); Yasuhiro Kawamura, Saitama (JP); Junya Negishi, Saitama (JP); Yoshita Tsukamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/580,905

(22) PCT Filed: Feb. 22, 2011

(86) PCT No.: PCT/JP2011/053852

§ 371 (c)(1),
(2), (4) Date: Aug. 23, 2012

(87) PCT Pub. No.: WO2011/105374

PCT Pub. Date: Sep. 1, 2011

(65) Prior Publication Data

US 2013/0000572 A1 Jan. 3, 2013

(30) Foreign Application Priority Data

Feb. 23, 2010 (JP) ..... 2010-037701

(51) Int. Cl.
*F01P 1/04* (2006.01)

(52) U.S. Cl.
USPC ..... 123/41.35; 92/186

(58) Field of Classification Search
USPC ..... 123/41.31, 41.34, 41.35, 193.6; 92/186
See application file for complete search history.

(56) References Cited

U.S. PATENT DOCUMENTS

| | | | | |
|---|---|---|---|---|
| 4,206,726 | A * | 6/1980 | Johnson et al. | 123/41.35 |
| 5,595,145 | A * | 1/1997 | Ozawa | 123/41.35 |
| 7,748,361 | B2 * | 7/2010 | Linz et al. | 123/193.6 |
| 2008/0017139 | A1 * | 1/2008 | Issler | 123/41.35 |
| 2008/0289490 | A1 * | 11/2008 | Linz et al. | 92/186 |

FOREIGN PATENT DOCUMENTS

| | | | |
|---|---|---|---|
| JP | 59043944 | A * | 3/1984 |
| JP | 01273821 | A * | 11/1989 |
| JP | 05-061423 | U | 8/1993 |
| JP | 08-165924 | A | 6/1996 |
| JP | 2006-090158 | A | 4/2006 |
| JP | 2006-090159 | A | 4/2006 |
| JP | 2007-224774 | A | 9/2007 |

* cited by examiner

*Primary Examiner* — Hung Q Nguyen
(74) *Attorney, Agent, or Firm* — Arent Fox LLP

(57) ABSTRACT

Disclosed is a piston cooling device wherein the cooling efficiency of a piston is improved by oil injected from an oil jet and supplied to a cooling passage provided in the piston, and the amount of cooling oil is reduced when an internal combustion engine is operated at maximum output. The piston cooling device is provided with a piston for an internal combustion engine, in which a circumferential passage and a cooling passage having an inlet passage and an outlet passage are provided, and an oil jet for injecting oil from an injection port to the inlet passage. The oil jet injects oil at every stroke of the piston so that a two-phase plug flow composed of gas and oil is formed in the cooling passage at least when an internal combustion engine is operated at maximum output.

5 Claims, 6 Drawing Sheets

PISTON COOLING DEVICE

CROSS-REFERENCE TO RELATED APPLICATION

This application is a National Stage entry of International Application No. PCT/JP2011/053852 filed Feb. 22, 2011, which claims priority to Japanese Patent Application No. 2010-037701 filed Feb. 23, 2010, the disclosure of the prior applications are hereby incorporated in their entirety by reference.

TECHNICAL FIELD

The present invention relates to a piston cooling device in which an oil injected from an oil jet is supplied to a cooling passage provided in a piston of an internal combustion engine and the piston is cooled by the oil flowing through the cooling passage.

BACKGROUND ART

With increase in power of an internal combustion engine, in a piston, a piston cooling device, which supplies a cooling oil injected from an oil jet to an annular cooling passage provided in the piston so as to cool a piston head having a piston top face in contact with a combustion gas, is well known.

For example, in a piston cooling device disclosed in Patent Literature 1, a cooling efficiency is improved by providing a guide portion which guides an oil injected from an oil jet to a circumferential passage of a cooling passage in a piston.

Also, at the time of high speed revolution of the internal combustion engine, if a speed of the piston in reciprocating motion becomes greater than that of the oil injected from the oil jet, a period during which the oil is not supplied to the cooling passage in the piston occurs. For this reason, a piston cooling device, which changes an injection speed of the oil injected from the oil jet so as to prevent an occurrence of the period during which the oil is not supplied to the cooling passage, is well known (for example, see Patent Literature 2).

PRIOR ART REFERENCE

Patent Literature

Patent Literature 1: JP 05-061423 U
Patent Literature 2: JP 2007-224774 A

SUMMARY OF THE INVENTION

Problems to be Solved by the Invention

When a pressure loss in the cooling passage in the piston is merely lowered so as to increase the cooling efficiency of the piston by the oil, there is a limit in improvement of the cooling efficiency and reduction in an amount of the oil injected from the oil jet.

Also, when an injection speed of the oil from the oil jet is changed, a device for changing the injection speed is required. Accordingly, the piston cooling device is upsized, and a production cost rises.

Further, when the internal combustion engine is operated at maximum output at which a temperature of the piston is at the highest value, the speed of the piston is high. In order to achieve a required cooling effect, the amount of the oil supplied from the oil jet is usually increased. Accordingly, there is a room for improving in reduction of the amount of the cooling oil.

In view of the foregoing, objects of the present invention is to improve a cooling efficiency of a piston by an oil injected from an oil jet to be supplied to a cooling passage provided in the piston at least at the time of a maximum output operation of an internal combustion engine, and to reduce an amount of the cooling oil for the piston in a high speed revolution region including the maximum output operation, by using a reciprocating motion in the piston.

Further, other objects of the present invention is to improve the cooling efficiency of the piston by the oil, and to reduce the amount of the cooling oil for the piston, by modifying a configuration the cooling passage of the piston.

Means for Solving the Problem

A first aspect of the present invention provides a piston cooling device, comprising: a piston 20 for an internal combustion engine in which a cooling passage C is provided, the cooling passage C having a circumferential passage 50 extending in a circumferential direction, and an inlet passage 30 and an outlet passage 40 communicating with the circumferential passage 50 respectively; and an oil jet 90 which injects an oil from an injection port 94 placed below the inlet passage 30 opening downward when the piston 20 reciprocates in an up-and-down direction, the oil injected from the injection port 94 flows into the inlet passage 30 and flows out of the outlet passage 40 through the circumferential passage 50, wherein an oil jet 90 injects the oil at every stroke of the piston 20 and an injection speed of the oil at the injection port 94 is equal to or less than a maximum speed of the piston 20 when the internal combustion engine E is operated at a maximum output operation such that a gas-liquid two-phase plug flow composed of a gas and the oil is formed in the cooling passage C at least when the internal combustion engine E is operated at the maximum output.

According to the first aspect of the present invention, since the gas-liquid two-phase plug flow composed of the gas and the oil is formed in the cooling passage of the piston by using the oil injected from the oil jet at the injection speed which is equal to or less than the maximum speed of the piston at least at the time of the maximum output operation of the piston which reciprocates at every stroke, this plug flow accelerates a heat transfer from the piston to the oil in the cooling passage, and a cooling efficiency of the piston by the oil can be improved. Also, by improvement in the cooling efficiency, an injection flow rate of the oil from the oil jet can be reduced while the required cooling effect of the piston is obtained.

Also, since the gas-liquid two-phase plug flow is moved up and down on a wall of the circumferential passage by an acceleration generated by the up-and-down movement of the piston, the cooling efficiency is further improved.

A second aspect of the present invention provides the piston cooling device of the first aspect, wherein the circumferential passage 50 comprises introduction passages 61 and 62; 161 and 162; 261 and 262 communicated with the inlet passage 30 at most upstream portions 61*a* and 62*a*; and main passages 71 and 72 communicated with the introduction passages 61 and 62; 161 and 162; 261 and 262 at most upstream portions 71*a* and 72*a*, and the introduction passages 61 and 62; 161 and 162; 261 and 262 are diffuser passages which extend upward and bend in circumferential directions so as to be communicated with the main passages 71 and 72, and cross-sectional areas thereof continuously increase toward the downstream.

According to the second aspect of the present invention, since the introduction passage is the diffuser passage whose cross-sectional area continuously increases, the cross-sectional area of the inlet passage communicated with the introduction passage can be reduced compared to that of an introduction passage which is not the diffuser passage, and the plug flow can be formed easily in the inlet passage.

Also, as the introduction passages which lead the oil injected from the oil jet to the inlet passage to the main passages extend upward, the introduction passages bend in the circumferential direction so as to communicate with the main passages. Accordingly, a backward flow and a stagnation, which occur when the oil passes through the inlet passage and strikes against the passage wall of the introduction passages, are prevented from being generated, and the oil can be guided to the main passages while keeping the energy of the oil in the introduction passages.

Also, since the introduction passages constitute the diffuser passages whose cross-sectional areas continuously increase, a kinetic energy of the oil from the inlet passage can be converted to a pressure energy smoothly. Accordingly, the pressure loss caused by a whirlpool and a separation can be reduced, and a required cooling effect of the piston can be obtained by the low injection speed and low injection flow rate of the oil from the oil jet.

A third aspect of the present invention provides the piston cooling device of the second aspect, wherein a increasing rate R which is defined by the following equation $$R=d(A^{1/2})/dS$$

is equal to or greater than 0.06 and is equal to or less than 0.8, where S (m) is a distance from the most upstream portions 61*a* and 62*a* on a passage center line Ld of the introduction passages 61 and 62; 161 and 162; 261 and 262, and A ($m^2$) is a cross-sectional area of the introduction passages 61 and 62; 161 and 162; 261 and 262 on a plane orthogonal to the passage center line Ld.

According to the third aspect of the present invention, by setting the increasing rate R within a range of $0.06 \leqq R \leqq 0.8$, a drop in the cooling effect caused by an increase in the resistance when the increasing rate is less than 0.06, and a drop in the cooling effect caused by a plug flow turbulence caused by the separation of the flow of the oil when the increasing rate is greater than 0.8 are prevented in the introduction passages. As a result, the cooling effect of the piston by the oil flowing through the cooling passage having the introduction passages which are bent diffuser passages can be improved while the injection flow rate of the oil from the oil jet is decreased.

A fourth aspect of the present invention provides the piston cooling device of any one of the first, second, and third aspect, wherein the introduction passages 61 and 62; 161 and 162 comprise first and second branch introduction passages 61 and 62; 161 and 162 which branch off in opposite circumferential directions each other at a branch portion 63, the main passages 71 and 72 comprise first and second main passages 71 and 72 communicated with the first and second branch introduction passages 61 and 62; 161 and 162 respectively, and the branch portion 63 is placed closer to a piston top face 21*a* than to the lowermost portions 71*e* and 72*c* of the first and second main passages 71 and 72 in the up-and-down direction.

According to the fourth aspect of the present invention, since the oil which strikes against the passage wall of the branch portion is prevented from flowing back toward the inlet passage, a small amount of injected oil can achieve a required cooling effect of the piston.

A fifth aspect of the present invention provides the piston cooling device of the fourth aspect, wherein the branch portion 63 is placed on the passage center line Li of the inlet passage 30.

According to the fifth aspect, unevenness of the amount of the oil flowing into the first and second branch introduction passages can be suppressed, the piston can be cooled evenly in the circumferential direction, and the injection flow rate of the oil from the oil jet can be decreased.

A sixth aspect of the present invention provides the piston cooling device of the fourth aspect, wherein passage cross-sections and the positions of the most upstream portions 61*a* and 62*a* of the first and second branch introduction passages 61 and 62; 161 and 162 are the same as those of the most downstream portion 32 of the inlet passage 30.

According to the sixth aspect, the first and second branch introduction passages overlap with each other in the circumferential direction, and regions occupied by the introduction passages in the piston can be reduced. Accordingly, a stiffness of the piston can be improved while the required cooling effect by the oil is kept.

A seventh aspect of the present invention provides the piston cooling device of any one of the first, third, fifth, and sixth aspects, wherein the oil discharged from the oil pump 96 is led to the oil jet 90 via an oil supplying passage 98, the oil jet 90 is provided with the oil passage 93 having the injection port 94, the oil decompressed by the orifice 92 is led from the oil supplying passage 98 to the oil passage 93, and an opening area of the injection port 94 is greater than a throttle cross-sectional area of the orifice 92.

According to the seventh aspect, the oil discharged from the oil pump is decompressed by the orifice and is led to the oil passage of the oil jet. Accordingly, the injection speed can be decreased, scattering and diffusion of the oil injected from the injection port can be prevented, and the oil can be supplied to the cooling passage efficiently. Also, since the oil pressure in the oil supplying passage which leads the oil from the oil pump to the oil jet can be kept high, the oil pump can be minimized.

Effect of the Invention

According to the present invention, by using a reciprocating motion of the piston, the cooling efficiency of the piston by the oil injected from the oil jet to be supplied to the cooling passage provided in the piston can be improved at least at the time of the maximum output operation of the internal combustion engine, and the amount of the cooling oil for the piston can be reduced in the high speed revolution region including the maximum output operation.

Further, by modifying the configuration of the cooling passage in the piston, the cooling efficiency of the piston by the oil can be improved, and the amount of the cooling oil for piston can be reduced.

EMBODIMENTS FOR CARRYING OUT THE INVENTION

Hereinafter, with reference to FIGS. 1-7. embodiments of the present invention will be explained.

FIGS. 1-5 explain the first embodiment of the present invention.

Figure 1:
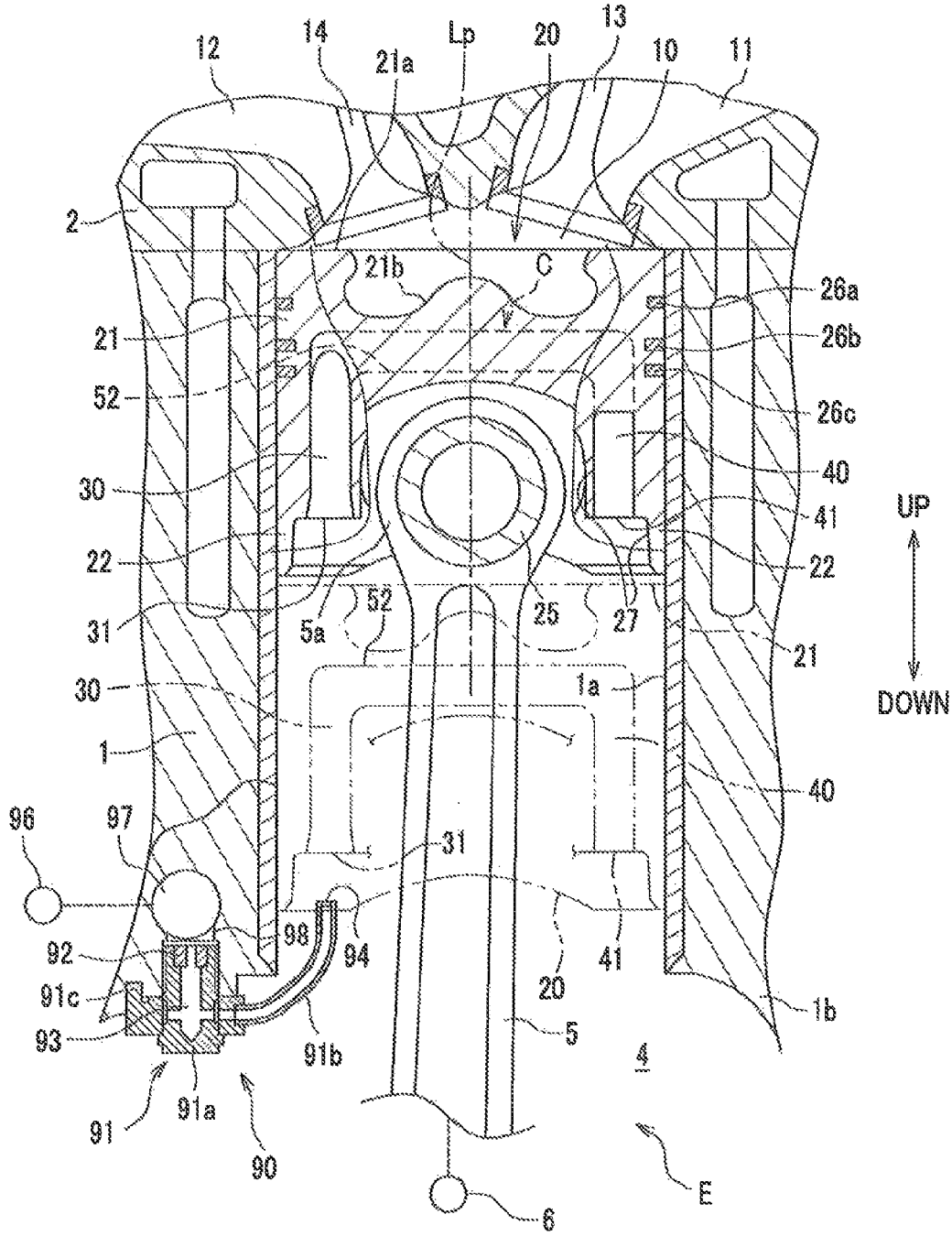
FIG. 1 shows a first embodiment of the present invention, and is a substantial sectional view of an internal combustion engine provided with a piston cooling device according to the present invention taken along the line including a central axis of a piston (i.e., along the line I-I in FIG. 2)

With reference to FIG. 1, an internal combustion engine F provided with a piston cooling device according to the present invention is a 4-stroke internal combustion engine. The internal combustion engine E is provided with an engine body comprising a cylinder block 1 provided with a cylinder bore 1*a* in which an internal combustion engine piston 20 is reciprocatably fitted; a cylinder head 2 connected to an upper end portion of the cylinder block 1; and an oil pan (not shown) connected to a lower end portion of the cylinder block 1 via a lower block (not shown).

In the cylinder block 1, a portion 1*b* which is lower than the cylinder bore 1*a* and serves as an upper crankcase, and a lower crankcase comprising the lower block and the oil pan constitute a crankcase 3. Also, in a crank chamber 4 constituted of the crankcase 3, a crankshaft 6 is connected to the piston 20 via a connecting rod 5 and is rotatably supported by the crankcase 3.

In addition, in this specification and claims, an up-and-down direction is parallel to a central axis Lp of the piston 20, but does not always mean a vertical direction. The up direction means a direction toward a piston top face 21*a* of the piston 20 in the up-and-down direction. Also, for convenience sake, a direction and a plane which are orthogonal to the central axis Lp are referred to as a horizontal direction and a horizontal plane respectively. Further, the central axis Lp is referred to as a center of the circumferential and radial direction. Still further, a planar view means viewing in the up-and-down direction.

A combustion chamber 10 is formed by the cylinder block 1, the piston 20, and the cylinder head 2 between the piston 20 and the cylinder head 2 in a direction parallel to the central axis Lp (i.e., in a direction parallel to a cylinder axis which is a central axis of the cylinder bore 1*a*). The cylinder head 2 is provided with an intake port 11 and an exhaust port 12 opening toward a combustion chamber 10 through openings, and an intake valve 13 and an exhaust valve 14 which open and close the intake port 11 and the exhaust port 12 respectively.

Also, an intake-air introduced via an intake system (not shown) is taken in from the intake port 11 to the combustion chamber 10 via the opened intake valve 13 at an intake stroke during which the piston 20 is moved downward, mixed with a fuel to be an air-fuel mixture, and compressed at a compression stroke during which the piston 20 is moved upward. The air-fuel mixture is ignited to be burned at an end of the compression stroke, and the piston 20 which is reciprocated by a pressure of the combustion gas drives the crankshaft 6 rotationally at an expansion stroke during which the piston 20 is moved downward. The combustion gas is exhausted to an outside of the internal combustion engine E as an exhaust gas from the combustion chamber 10 via the opened exhaust valve 14, the exhaust port 12, and an exhaust system (not shown) connected to the exhaust port 12 at an exhaust stroke during which the piston 20 is moved upward.

Here, the intake stroke and the expansion stroke mean a down stroke of the piston 20 respectively, and the compression stroke and the exhaust stroke mean an up stroke of the piston 20 respectively. Also, the fuel supplied to the intake-air is injected from a fuel injection valve (not shown) in the combustion chamber 10 or an intake passage including the intake port 11.

Also, in FIG. 1, a top dead center position of the piston 20 is shown by a solid line, and a bottom dead center position of the piston 20 is shown by a chain double-dashed line.

Figure 2:
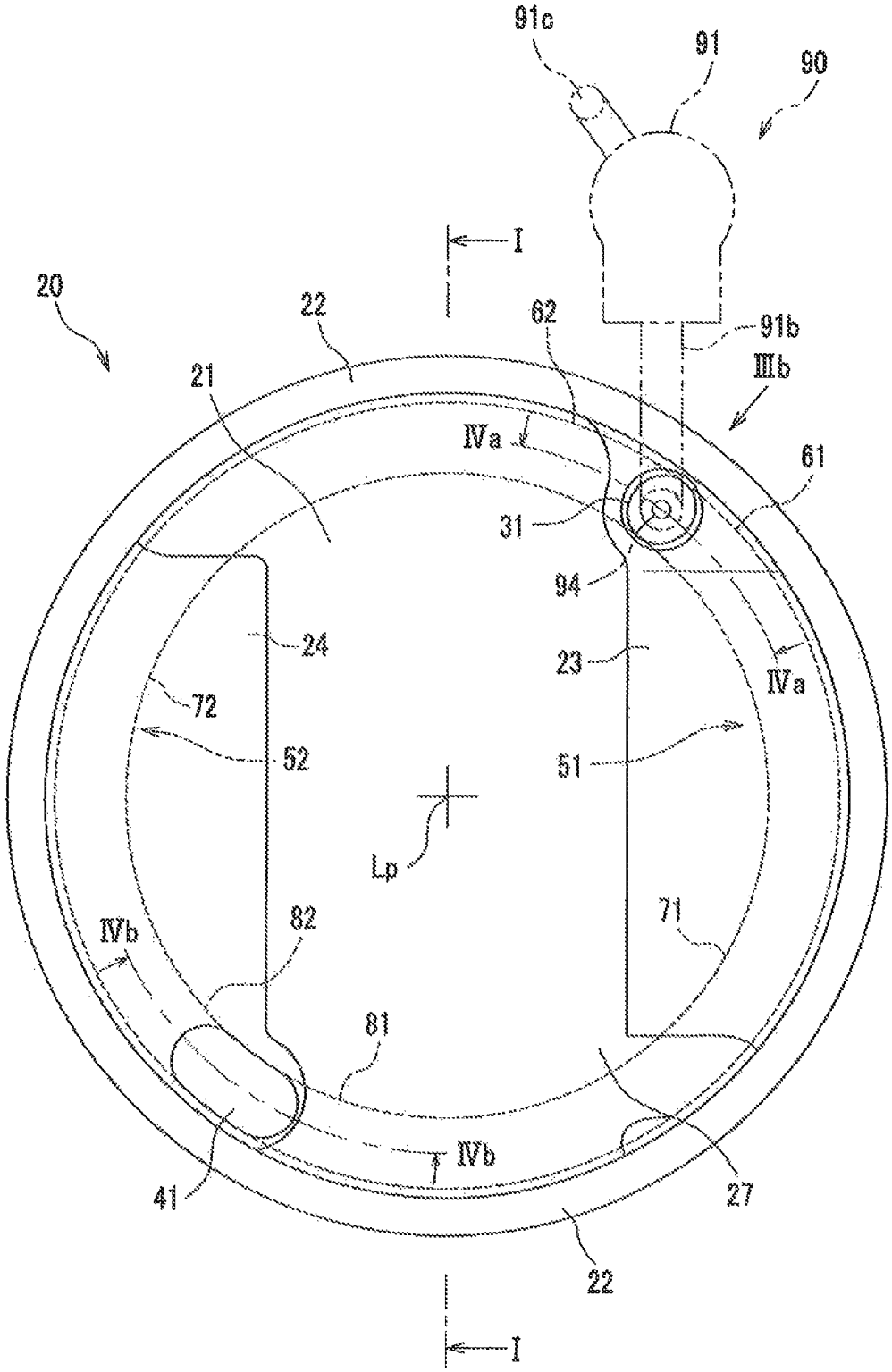
FIG. 2 is a substantial bottom view of the piston shown in FIG. 1.

With reference to FIGS. 1 and 2, the metal piston 20 has a cylindrical piston head 21 having the piston top face 21*a* to which a pressure of the combustion gas in the combustion chamber 10 is applied, a pair of piston skirts 22 extending from the piston head 21 downward along the up-and-down direction, and a pair of first and second pin bosses 23 and 24 for supporting a piston pin 25 to which a small end portion 5*a* of the connecting rod 5 is rotatably connected.

The piston top face 21*a* is provided with a recess 21*b*. Ring grooves for receiving first, second, and third piston rings 26*a*, 26*b*, and 26*c* are provided on an outer circumferential surface of the piston head 21. Pin bosses 23 and 24 are provided with insert holes 23*a* and 24*a* into which a piston pin 25 is pressed (see FIG. 3).

With reference to FIGS. 1-4, in the piston head 21 of the piston 20, an annular circumferential passage 50 extending in a circumferential direction, and a cooling passage C having an inlet passage 30 and an outlet passage 40 which communicate with the circumferential passage 50 respectively and linearly extend in the up-and-down direction, are provided.

An inlet 31 of the inlet passage 30 and an outlet 41 of the outlet passage 40 open downward in a piston undersurface 27 constituted of a bottom and an inner circumferential surface of the piston 20 at positions adjacent to the first and second pin bosses 23 and 24 in the circumferential direction respectively.

A passage center line Li of the inlet passage 30 and a passage center line Lo of the outlet passage 40 are approximately symmetrical about the central axis Lp.

In addition, the wording "approximately" includes a situation without the wording "approximately" and means that no significant difference exists with respect to operation and effect between situations with and without the wording "approximately" although the situation with the wording "approximately" is not identical with the situation without the wording "approximately".

The annular circumferential passage 50 is composed of half annular first and second circumferential passages 51 and 52 extending in a circumferential direction between the inlet passage 30 and the outlet passage 40. The circumferential passages 51 and 52 have introduction passages 61 and 62 communicated with a most downstream portion 32 of the inlet passage 30 at the most upstream portions 61*a* and 62*a*, delivery passages 81 and 82 communicated with a most upstream portion 42 of the outlet passage 40 at the most downstream portions 81*b* and 82*b*, and main passages 71 and 72 communicated with most downstream portions 61*a* and 62*b* of the introduction passages 61 and 62 at the most upstream portions 71*a* and 72*b* and communicated with most upstream portions 81*b* and 82*a* of delivery passages 81 and 82 at the most downstream portions 71*b* and 72*b* respectively. The main passages 71 and 72 are approximately parallel to a horizontal plane.

Here, the terms "upstream" and "downstream" relates to a stream of the cooling oil as a coolant in the cooling passage C. In the cooling passage C, the inlet 31 is the most upstream, and the outlet 41 is the most downstream.

The first and second circumferential passages 51 and 52 (i.e., the first and second introduction passages 61 and 62, the first and second main passages 71 and 72, and the first and second delivery passages 81 and 82) are approximately symmetrical each other about one of planes including the central axis Lp. Also, in a planar view, the inlet passage 30, the outlet passage 40, and the first and second circumferential passages 51 and 52 are placed within a range of an annular ring around the central axis Lp respectively. A radial direction width of the annular ring is equal to the largest radial direction width in those of the introduction passages 61 and 62, the main passages 71 and 72, and the delivery passages 81 and 82.

Figure 3A:
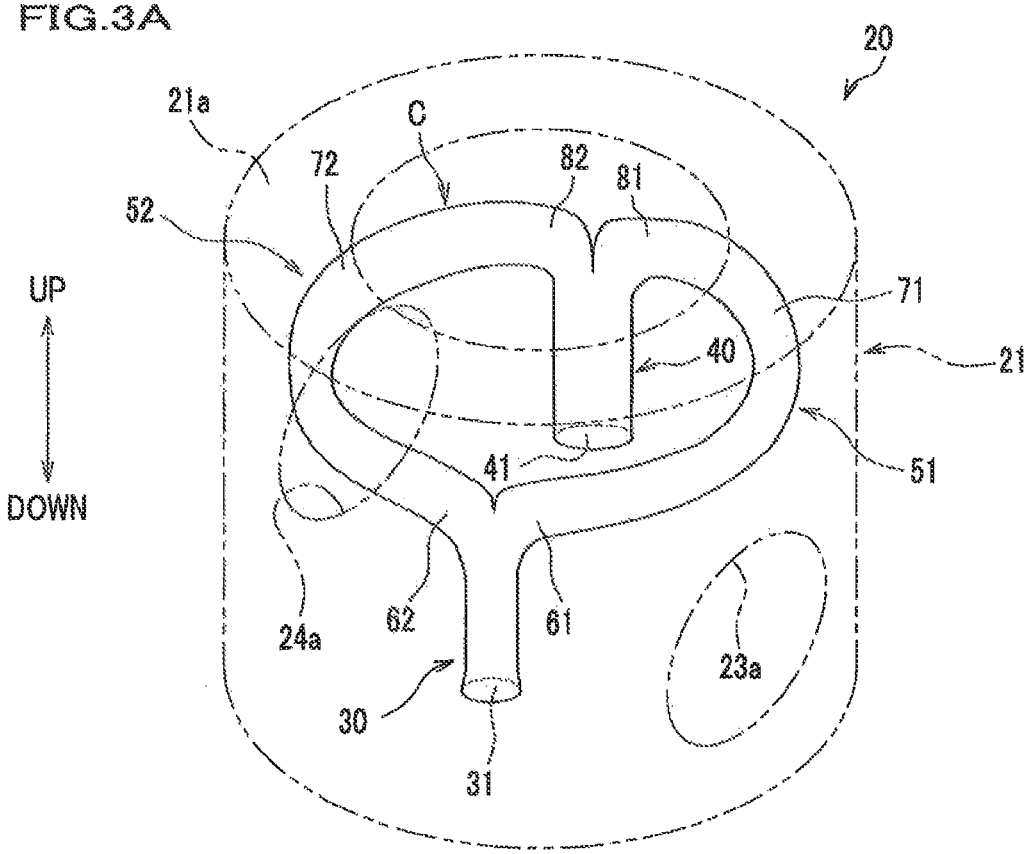
FIG. 3A is a visualized substantial perspective view of a cooling passage in the piston shown in FIG. 1.
Figure 3B:
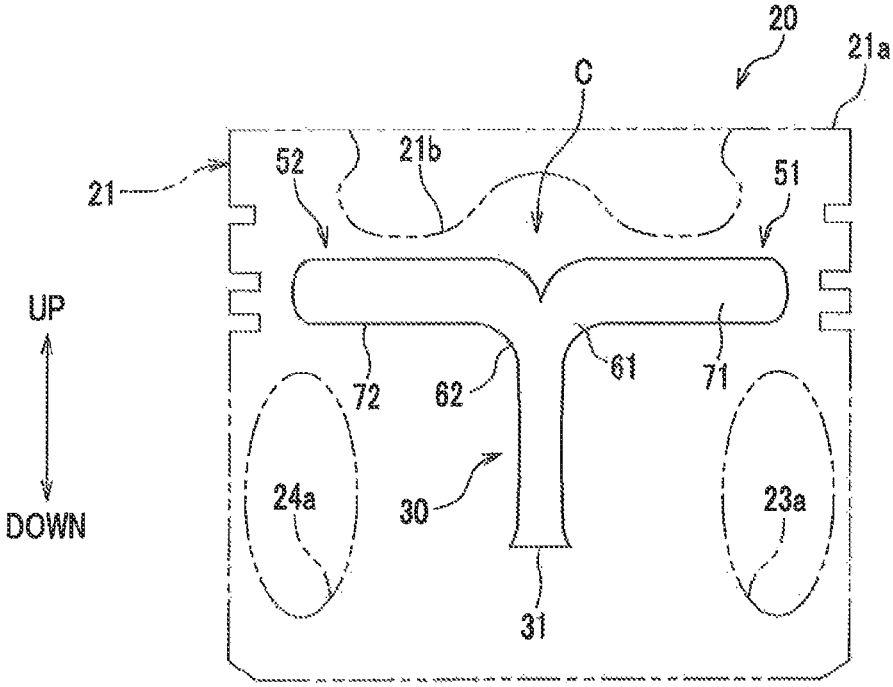
FIG. 3B is a sectional view of FIG. 3A viewed in a direction of IIIb shown in FIG. 2.
Figure 4A:
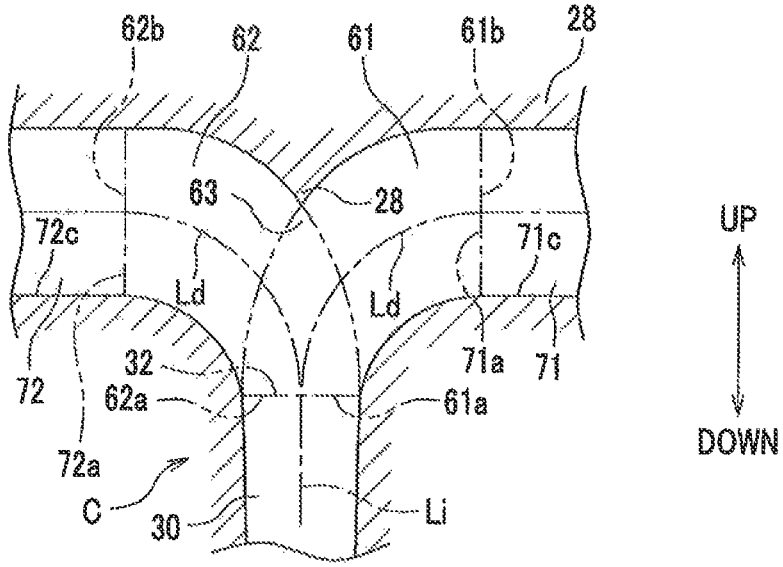
FIG. 4A is a sectional view of the cooling passage taken along the line IVa-IVa shown in FIG. 2.
Figure 4B:
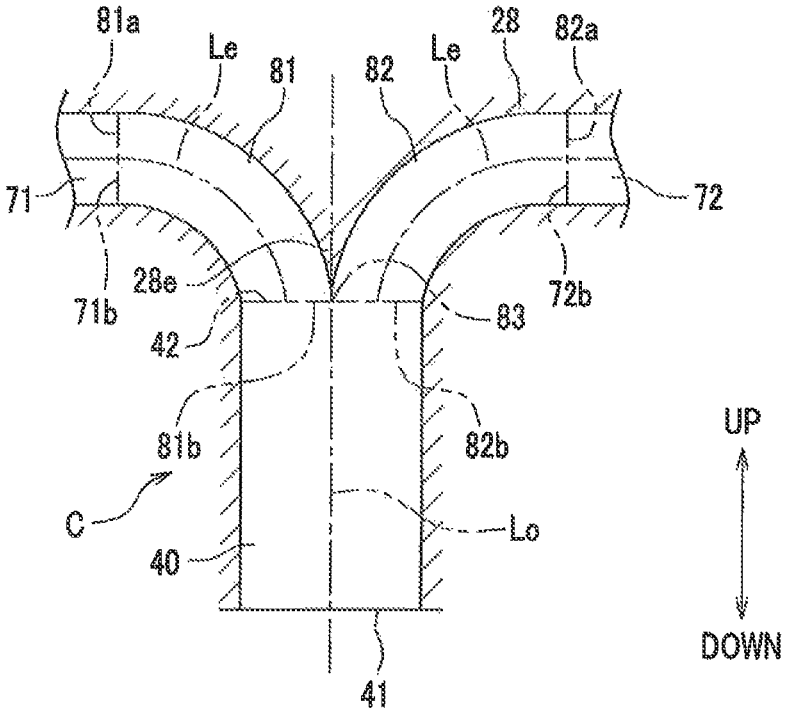
FIG. 4B is a sectional view of the cooling passage taken along the line IVb-IVb shown in FIG. 2.

With reference to FIGS. 3 and 4, the first and second introduction passages 61 and 62 having a passage center line Ld extend from the most downstream portion 32 of the inlet passage 30 upward (or toward the downstream), and bend from a branch portion 63 above the most downstream portion 32 in opposite circumferential directions respectively so as to be apart from each other. The branch portion 63 is formed of a branch wall 28*d* including a portion projecting downward in the passage wall 28 of the cooling passage C.

Also, as the first and second delivery passages 81 and 82 having a passage center line Le extend from the most downstream portions 71*b* and 72*b* of the main passages 71 and 72 downward (or toward the downstream), the first and second delivery passages 81 and 82 bend from the most downstream portions 71*h* and 72*h* in opposite circumferential directions so as to be closed to each other.

The first and second main passages 71 and 72 of the first and second circumferential passages 51 and 52 are approximately parallel to the horizontal plane respectively. The main passages 71 and 72 have approximately uniform cross-sectional areas, and a flow rate of the oil in the main passages 71 and 72 is kept constant.

The first and second introduction passages 61 and 62 constitute first and second branch introduction passages which branch of from the branch portion 63 respectively. The branch portion 63 is placed on the passage center line Li of the inlet passage 30.

Also, passage cross-sections and positions of the most upstream portions 61*a* and 62*a* of the first and second introduction passages 61 and 62 are the same as those of the most downstream portion 32 of the inlet passage 30 respectively, and the passage center line Li conforms to the passage center line Ld at the most downstream portion 32, and the most upstream portions 61*a* and 62*a*. For this reason, the introduction passages 61 and 62 function as passages which overlap with each other above the inlet passage 30. In addition, in FIG. 4A, imaginal extended passages of the introduction passages 61 and 62 are shown by a chain double-dashed line.

The first and second introduction passages 61 and 62 branch off in opposite circumferential directions each other at the branch portion 63. The first and second main passages 71 and 72 are communicated with the introduction passages 61 and 62 respectively. Since the branch portion 63 is placed closer to the piston top face 21*a* (see FIG. 1) than to the lowermost portions 71*c* and 72*c* of the main passages 71 and 72 in the up-and-down direction, the oil which strikes against the branch wall 28*d* of the branch portion 63 is prevented from flowing back toward the inlet passage 30. Accordingly, a small amount of injected oil can achieve a required cooling effect of the piston 20.

With respect to the cross-sectional areas of the introduction passages 61 and 62, most upstream cross-sectional areas of the most upstream portions 61*a* and 62*a* are less than most downstream cross-sectional areas of the most downstream portions 61*a* and 62*b*. In this embodiment, the cross-sectional areas of the introduction passages 61 and 62 continuously increase from the upstream to the downstream at an approximately constant increasing rate R throughout the introduction passages 61 and 62. For this reason, the introduction passages 61 and 62 are diffuser passages whose cross-sectional are continuously increase along a flowing direction of the oil.

Also, the increasing rate R is defined by a slight change in square root of a cross-sectional area A ($m^2$) of the introduction passages 61 and 62 on a plane orthogonal to the passage center line Ld to a slight change in a distance S (m) from the most upstream portions 61*a* and 62*a* toward the downstream on the passage center line Ld of the introduction passages 61 and 62 as follows:

$$R=d(A^{1/2})/dS$$

This increasing rate R means a value of a degree in an expanse of the introduction passages 61 and 62 from the most upstream portions 61*a* and 62*a* toward the downstream (or a degree in an increase of the cross-sectional area A of the introduction passages 61 and 62).

When the increasing rate R is equal to 0, the cross-sectional area A of the introduction passages 61 and 62 does not change relative to the distance S and is kept constant. Accordingly, the increasing rate R should be greater than 0 such that the introduction passages 61 and 62 are diffuser passages.

On the other hand, when the increasing rate R becomes large so that the flow is separated from the passage wall 28 in the introduction passages 61 and 62, a turbulence of the flow of the oil becomes large in the introduction passages 61 and 62 and the main passages 71 and 72 downstream from the separation position, it becomes difficult to keep a plug flow described below in the first and second circumferential passages 51 and 52, and the cooling effect by the plug flow is lowered.

The cross-sectional areas of the delivery passages 81 and 82 are approximately constant from the upstream to the downstream throughout the delivery passages 81 and 82, and are greater than those of the introduction passages 61 and 62 at the most upstream portions 61*a* and 62*a*.

Also, the delivery passages 81 and 82 constitute first and second delivery passages which branch off at a branch portion 83 formed of a branch wall 28*e* including a portion projecting downward in the passage wail 28 of the cooling passage C respectively. Also, the branch portion 83 (or the branch wall 28*e*) is approximately placed at the most upstream portion 42, and is approximately placed on the passage center line Lo of the outlet passage 40. For this reason, the flow of the oil in the most downstream portions 81*b* and 82*b* is approximately parallel to the up-and-down direction and is directed downward.

Also, since the cross-sectional areas of the delivery passages 81 and 82 are greater than those of the introduction passages 61 and 62, resistances of the delivery passages 81 and 82 become small. Also, since the delivery passages 81 and 82 are bent passages which continue smoothly and the most downstream portions 81*b* and 82*b* are directed downward, the oil which flows from the first and second main passages 71 and 72 to the delivery passages 81 and 82 is prevented from striking in the circumferential direction by the branch wall 28*e* and is directed downward. As a result, the oil is exhausted from the outlet 41 of the cooling passage C smoothly.

With reference to FIGS. 1 and 2, an oil jet 90, which is placed below the piston 20 reciprocating in the up-and-down direction for injecting the cooling oil toward the inlet 31 of the inlet passage 30 as a coolant injection member, is provided below the inlet 31 of the inlet passage 30 in the cylinder block 1.

The oil injected from the oil jet 90 into the inlet passage 30 cools the piston 20 while passing through the circumferential passages 51 and 52 and flows out of the outlet passage 40. Accordingly, the piston 20 provided with the cooling passage C, and the oil jet 90 constitute the piston cooling device which is provided in the internal combustion engine E and cools the piston 20.

The oil jet 90 is provided with a body 91, and an orifice 92 provided in a mounting portion 91*a* as a decompression member. The body 91 has the mounting portion 91*a* fixed to the cylinder block 1, an injection pipe 91*b* provided with the injection port 94, and a cylindrical positioning portion 91*c* for positioning the oil jet 90 at the cylinder block 1.

The body 91 is provided with a main gallery 97 as an oil supplying passage provided in the cylinder block 1, and an injected oil passage 93 such that the oil supplied from the oil pump 96 which functions as an oil source is led through the main gallery 97 and an oil introduction passage 98 communicated with the main gallery 97. The oil passage 93 has the injection port 94 which is provided in the injection pipe 91*b* and has an opening in the crank chamber 4. The injection port 94 is approximately parallel to the central axis Lp and is directed to the inlet 31. The inlet passage 30 including the inlet 31 is placed to overlap the injection port 94 in the planar view.

The oil pump 96 is a volume-type rotary pump driven by the crankshaft 6, and an amount of the supplied oil is increased in proportion to an increase in an engine rotational speed.

The orifice 92 placed between the main gallery 97 and the oil passage 93 decreases an oil pressure in the main gallery 97. Accordingly, the oil whose pressure is decreased is led to the oil passage 93 via the orifice 92. As another example, the orifice 92 may be provided in the oil introduction passage 98 which leads the oil in the main gallery 97 to the oil jet 90 by making the main gallery 97 communicate with the oil jet 90.

An opening area of the injection port 94 is greater than a throttle cross-sectional area of the orifice 92. By enlarging the opening area of the injection port 94, a diameter of a conical injection flow of the oil can be enlarged, and unevenness in distribution caused by the branch can be decreased. Also, since the throttle cross-sectional area of the orifice 92 is less than the opening area of the injection port 94, an decrease in the oil pressure of the main gallery 97 is suppressed, the injection speed is decreased, and an amount of the injection flow can be decreased.

When the internal combustion engine E is operated, the oil jet 90 continuously injects the oil toward the inlet 31 in the cooling passage C in the down stroke of the piston 20 in the intake and expansion strokes and the up stroke in the compression and exhaust strokes such that a gas-liquid two-phase plug flow (or a slug flow) composed of the oil and air in the crank chamber 4 is formed at least at the time of the maximum output operation.

The injection speed of the oil (hereinafter, referred to as an "injection speed") depends on the oil pressure in the oil passage 93, the oil pressure in the oil passage 93 depends on an rotational speed of the oil pump 96 (i.e., the engine rotational speed) and is increased in proportion to the increase in the engine rotational speed. Here, the injection speed means an injection speed at the injection port 94.

Also, the injection speed is set at a value equal to or less than a maximum speed of the piston 20 at the time of maximum output operation (hereinafter, referred to as a "piston maximum speed"), preferably 30% or more than and 90% or less than the piston maximum speed.

When the injection speed is less than 30% or more than 90% of the piston maximum speed, a reliability of forming the plug flow in the cooling passage C at the time of the maximum output operation is lowered, and a cooling effect of the piston 20 by the oil in the cooling passage C at the time of the maximum output operation is lowered.

Hereinafter, the plug flow will be explained in detail.

Generally, it is well known that in a passage through which a gas and a liquid flow, the gas-liquid two-phase plug flow which means that a large bubble whose diameter is over the passage cross-section (hereinafter, referred to as a "gas plug") and a liquid portion which is divided by the gas plug and whose diameter is over the passage cross-section (hereinafter, referred to as a "liquid plug") flow alternately when a flow rate of the gas is within a predetermined flow rate range relative to a flow rate of the liquid. On the other hand, it is well known that when the flow rate of the gas is out of the predetermined flow rate range, a gas-liquid two-phase flow other than the plug flow is formed. For example, when the flow rate of the gas is less than the predetermined flow rate range, a bubble flow in which small bubbles are dispersed in the liquid whose diameter is over the passage cross-section is formed, and when the flow rate of the gas is more than the predetermined flow rate range, the liquid flows along the passage wall like a film so as to be an annular flow of the gas flowing a center portion of the passage.

Also, in the plug flow, a circulating flow of the liquid generated in the liquid plug accelerates heat transfer between the passage wall and the liquid, and the cooling effect by the oil is improved.

Accordingly, when the internal combustion engine E is operated at maximum output at which a temperature of the piston 20 is at the highest value, the injection speed and injection flow rate (hereinafter, merely referred to as an "injection flow rate") of the oil injected from the oil jet 90 are set such that the plug flow is formed in the circumferential passages 51 and 52 in order to improve the cooling effect of the piston 20 by the oil flowing through the cooling passage C at least at the time of the maximum output operation.

Provided that the injection speed is set at a value equal to or less than the piston maximum speed at the time of the maximum output operation, preferably 30% and more than and 90% or less than the piston maximum speed, the injection speed and the injection flow rate are determined based on an experiment and a simulation, etc. in consideration that the oil injected from the oil jet 90 is slowed down by an air resistance before arriving at the inlet 31 during one reciprocating stroke comprising the down stroke and the up stroke of the piston 20, that a period during which the oil is not supplied is kept even if the injection speed is equal to the piston maximum speed at the time of the maximum output operation, and that the oil injected from the oil jet 90 flows into the inlet passage 30 with air in the crank chamber 4. Also, although the injection flow rate has an upper limit, the higher the injection flow rate, the higher the cooling effect before the upper limit is achieved.

With reference to FIG. 4A, in a relationship between the first and second introduction passages 61 and 62 and the plug flow, the plug flow described below is formed in the inlet passage 30, is divided into two flows in the circumferential direction by the branch wall 28*d*, and plug flows are formed in the introduction passages 61 and 62.

Also, since the introduction passages 61 and 62 are diffuser passages whose cross-sectional areas are continuously increased (i.e., increasing rate R>0), the cross-sectional area of the inlet passage 30 communicated with the most upstream portions 61*a* and 62*a* of the introduction passages 61 and 62 can be reduced compared to the introduction passage which does not become a diffuser passage, and the plug flow can be formed easily in the inlet passage 30. In addition, since the introduction passages 61 and 62 continuously (i.e., smoothly) bend without step, the plug flow formed in the inlet passage 30 is divided by the branch wall 28*d*, and is led from the inlet passage 30 extending in the up-and-down direction to the main passages 71 and 72 extending in the horizontal direction.

Figure 5:
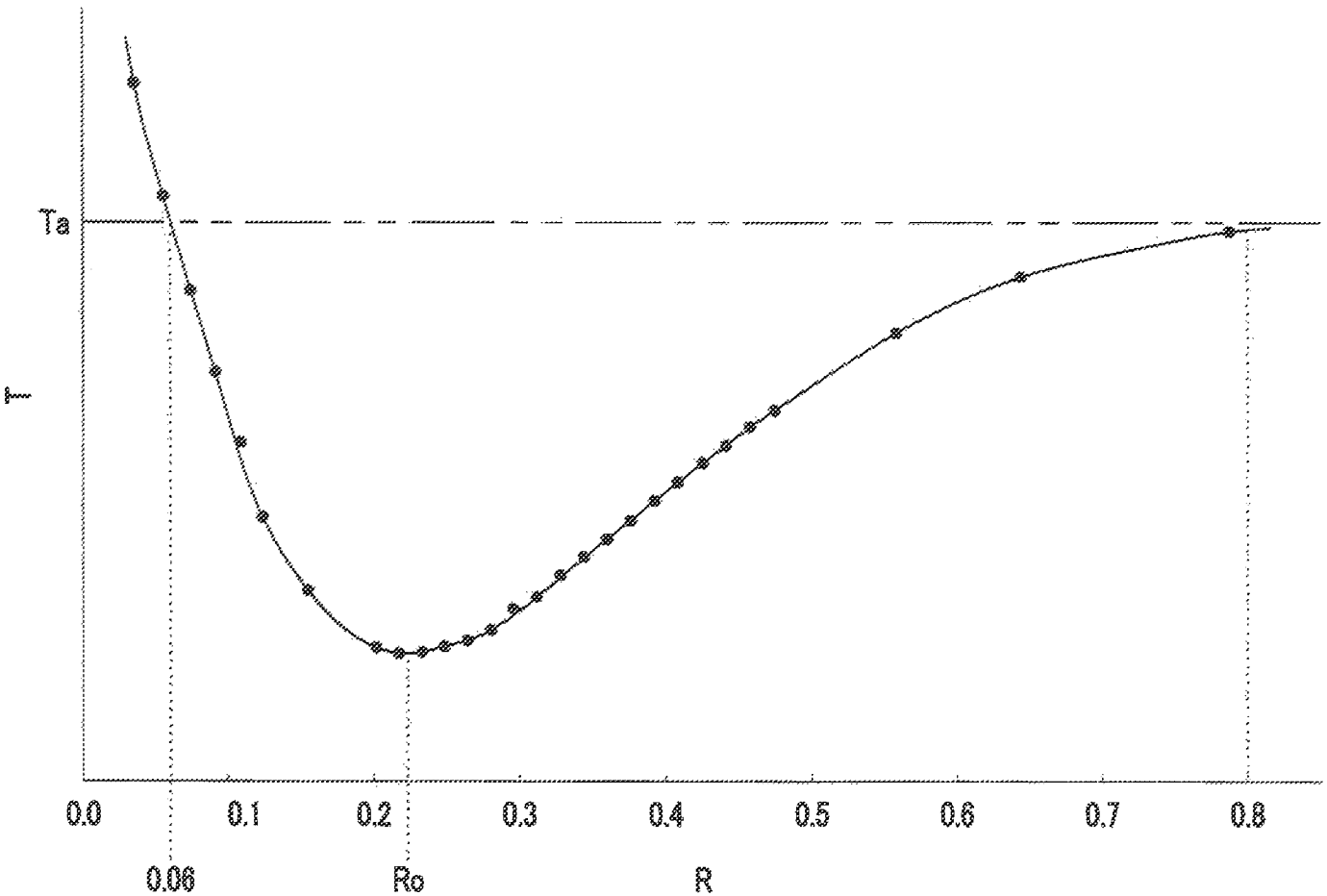
FIG. 5 is a graph showing a relationship between a temperature T of a top face of the piston shown in FIG. 1 and an increasing rate R of an introduction passage of the cooling passage at the time of maximum output operation of the internal combustion engine.

Also, with respect to FIG. 5, it is found that the cooling effect of the piston 20 by the plug flow is changed depending on the increasing rate R of the introduction passages 61 and 62. In addition, with respect to a relationship between the increasing rate R and the cooling effect at the time of the maximum output operation of the internal combustion engine F, there is a correlation which is the same as the correlation shown in FIG. 5 and does not depend on the injection speed and the injection flow rate within ranges of the injection speed and the injection flow rate where the plug flow can be formed in the cooling passage C.

The reason why the cooling effect by the plug flow is changed depending on the increasing rate R as described above is that the lower the increasing rate R relative to an optimal increasing rate Ro at which the cooling effect is maximized, the higher the resistances in the introduction passages 61 and 62 and the loser the cooling effect. Also, the higher the increasing rate R relative to the optimal increasing rate Ro, the flow of the oil through the introduction passages 61 and 62 tends to separate from the passage wall. Accordingly, contact between the liquid plug of the plug flow and the passage wall is unstabilized, and the cooling effect is lowered.

For this reason, high cooling effect of the piston 20 compared to a standard piston can be obtained at the time of the maximum output operation of the internal combustion engine E (see FIG. 1) under conditions that the injection speed and the injection flow rate of the oil injected from the oil jet 90 are the same as those for the standard piston. In other words, in FIG. 5, the increasing rate R is set within a range of $0.06 \leqq R \leqq 0.8$ such that a top face temperature T of the piston 20 is less than a top face temperature Ta of the standard piston.

Here, the standard piston means a piston whose cooling passage does not have a passage portion corresponding to the introduction passages 61 and 62 (see FIGS. 3 and 4) and has a configuration (a configuration a cooling passage shown in a drawing corresponding to FIG. 3B is T-shaped) where the main passages 71 and 72 (see FIGS. 3 and 4) are directly communicated with the inlet passage 30.

Also, the increasing rate R is preferably set a value within a range of $0.5Ro \leqq R \leqq 2Ro$ in order to obtain higher cooling effect than that of the standard piston.

In addition, the oil pressure in the oil passage 93 and the oil pressure in the main gallery 97 change depending on the engine rotational speed. Also, when the internal combustion engine E is operated at an engine rotational speed which is lower than that at the time of the maximum output operation, the temperature of the piston 20 is lower than that at the time of the maximum output operation. Accordingly, when the internal combustion engine F is operated at the lower engine rotational speed, the injection speed or the injection flow rate may be determined such that the bubble flow is formed without forming the plug flow in the cooling passage C.

Next, an operational advantage of the above embodiment will be explained.

The piston cooling device is provided with the piston 20 provided with the cooling passage C, and the oil jet 90 which injects the oil from the injection port 94 placed below the inlet passage 30 opening downward when the piston 20 reciprocates in the up-and-down direction. The oil jet 90 injects the oil at every stroke of the piston 20 such that the gas-liquid two-phase plug flow composed of the gas and the oil is formed in the cooling passage C at the time of the maximum output operation of the internal combustion engine E. Also, the injection speed of the oil in the injection port 94 is equal to or less than the maximum speed of the piston 20 at the time of the maximum output operation.

According to the above structure, by using the reciprocating motion of the piston 20, and the oil injected from the oil jet 90 at an injection speed which is equal to or less than the maximum speed of the piston 20 at least at the time of the maximum output operation of the piston 20 which reciprocates at every stroke, the gas-liquid two-phase plug flow composed of the gas and the oil is formed in the cooling passage C. This plug flow accelerates a heat transfer from the piston 20 to the oil in the cooling passage C, and the cooling efficiency of the piston 20 by the oil can be improved. Also, by improvement in the cooling efficiency, the injection flow rate of the oil from the oil jet 90 and the amount of the oil for cooling the piston can be reduced while the required cooling effect of the piston 20 is obtained. Also, since the gas-liquid two-phase plug flow is moved up and down on a wall of the circumferential passage 50 by an acceleration generated by the up-and-down movement of the piston 20, the cooling efficiency is further improved. Further, the oil pump 96 for supplying the oil to the oil jet 90 can be minimized, loss in power thr driving the oil pump 96 is reduced, and a fuel efficiency is improved.

The circumferential passages 51 and 52 comprise the introduction passages 61 and 62 communicated with the inlet passage 30 at the most upstream portions 61*a* and 62*a*, and the main passages 71 and 72 communicated with the introduction passages 61 and 62 at the most upstream portions 71*a* and 72*h*. As the introduction passages 61 and 62 are the diffuser passages extending upward, the introduction passages 61 and 62 bend in the circumferential direction so as to be communicated with the main passages 71 and 72, and cross-sectional areas thereof continuously increase toward downstream at a constant increasing rate R.

According to this structure, as the introduction passages 61 and 62 which lead the oil injected from the oil jet 90 to the inlet passage 30 to the main passages 71 and 72 extend upward, the introduction passages 61 and 62 bend in the circumferential direction so as to be communicated with the main passages 71 and 72. Accordingly, a backward flow and a stagnation, which occur when the oil passes through the inlet passage 30 and strikes against the passage wall 28 of the introduction passages 61 and 62, are prevented from being generated, and the oil can be guided to the main passages 71 and 72 while keeping energy of the oil in the introduction passages 61 and 62.

Also, since the introduction passages 61 and 62 constitute the diffuser passages whose cross-sectional areas continuously increase at an increasing rate R, a kinetic energy of the oil from the inlet passage 30 can be converted to a pressure energy smoothly. Accordingly, the pressure loss caused by a whirlpool and a separation can be reduced, and a required cooling effect of the piston 20 can be obtained by the low injection speed and low injection flow rate oil from the oil jet 90.

Further, since the introduction passages 61 and 62 are diffuser passages whose cross-sectional areas are continuously increase at the increasing rate R (R>0), a cross-sectional area of the inlet passage 30 communicated with the most upstream portions 61*a* and 62*a* of the introduction passages 61 and 62 can be reduced compared to that of the introduction passage which is not a diffuser passage and the plug flow can be formed easily in the inlet passage 30.

Also, by setting the increasing rate R within a range of $0.06 \leqq R \leqq 0.8$, a drop in the cooling effect caused by an increase in the resistance when the increasing rate is less than 0.06, and a drop in the cooling effect caused by a plug flow turbulence caused by the separation of the flow of oil when the increasing rate is greater than 0.8 are prevented in the introduction passages 61 and 62. As a result, the cooling effect of the piston 20 by the oil flowing through the cooling passage C having the introduction passages 61 and 62 which are bent diffuser passages can be improved while the injection flow rate of the oil from the oil jet 90 is decreased. Further, by setting the increasing rate R within a range of $0.5Ro \leqq R \leqq 2Ro$ including the optimal increasing rate Ro, the higher cooling effect can be obtained.

Since unevenness of the amount of the oil flowing into the first and second branch introduction passages 61 and 62 can be suppressed by placing the branch portion 63 on the passage center line Li of the inlet passage 30, the piston 20 can be cooled evenly in the circumferential direction, and the injection flow rate of the oil from the oil jet 90 can be decreased.

The passage cross-sections and the positions of the most upstream portions 61*a* and 62*a* of the first and second introduction passages 61 and 62, which are the first and second branch introduction passages and constitute the diffuser passage, are the same as those of the most downstream portion 32 of the inlet passage 30 respectively, and the passage center line Li conforms to the passage center line Ld at the most downstream portion 32, and the most upstream portions 61*a* and 62*a*.

According to this structure, the introduction passages 61 and 62 overlap with each other in the circumferential direction, and regions occupied by the introduction passages 61 and 62 in the piston 20 can be reduced. Accordingly, a stiffness of the piston 20 can be improved while the required cooling effect of the piston 20 by the oil is kept.

The oil discharged from the oil pump 96 is led to the oil jet 90 via the main gallery 97, and the oil jet 90 is provided with the oil passage 93 having the injection port 94. The oil decompressed by the orifice 92 is led from the main gallery 97 to the oil passage 93, and an opening area of the injection port 94 is greater than a throttle cross-sectional area of the orifice 92.

According to this structure, the oil discharged from the oil pump 96 is decompressed by the orifice 92 and is led to the oil passage 93 of the oil jet 90. Accordingly, the injection speed can be decreased, scattering and diffusion of the oil injected from the injection port 94 can be prevented, and the oil can be supplied to the cooling passage C efficiently. Also, since the oil pressure in the oil supplying passage which leads the oil from the oil pump 96 to the oil jet 90 can be kept high, the oil pump 96 can be minimized.

As described above, improvement in the cooling efficiency of the piston P by the oil and reduction in the amount of the cooling oil for piston can be achieved by making the configuration of the cooling passage C in the piston 20 appropriately.

Figure 6:
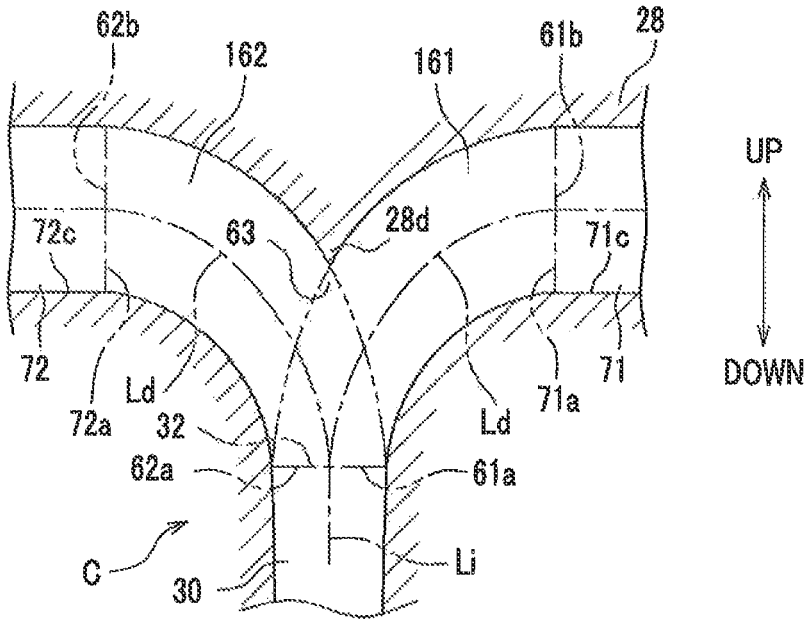
FIG. 6 is a sectional view corresponding to FIG. 4A and shows a second embodiment of the present invention.

Next, with reference to FIG. 6, a second embodiment of the present invention will be explained. Also, with reference to FIG. 7, a third embodiment of the present invention will be explained. The second and third embodiments differ from the first embodiment in the introduction passages 61 and 62. With respect to other components, the second and third embodiments have the same components as those of the first component. For this reason, detailed descriptions of the same components will be omitted. Note that the same numerical references are used for the same components.

First and second introduction passages 161 and 162 of the second embodiment have an increasing rate R which is greater than that of the introduction passages 61 and 62 of the first embodiment, and have the same dimensions as those of the introduction passages 61 and 62.

The introduction passages 261 and 262 of the third embodiment have the same increasing rate R as that of the second embodiment.

Figure 7:
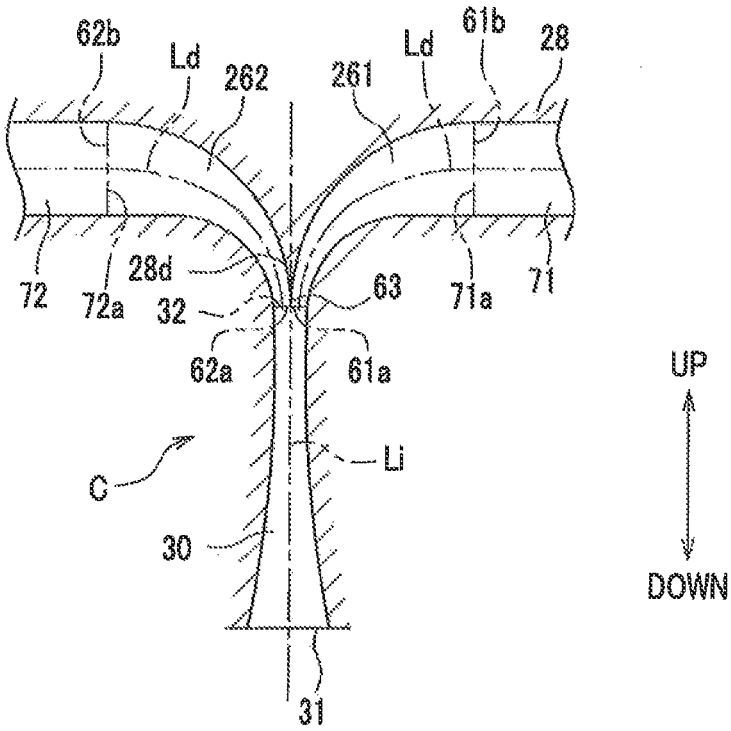
FIG. 7 is a sectional view corresponding to FIG. 4A and shows a third embodiment of the present invention.

In FIG. 7, the first and second introduction passages 261 and 262 extend from the most downstream portion 32 of the inlet passage 30 upward (or toward the downstream), and bend in opposite circumferential directions respectively so as to be apart from the most downstream portion 32. Also, the branch portion 63 (or the branch wall 28*d*) approximately placed at the most downstream portion 32, and is approximately placed on the passage center line Li of the inlet passage 30. Accordingly, the introduction passages 261 and 262 are independently communicated with the main passages 71 and 72 respectively.

Hereinafter, modified portions of the above embodiments will be explained.

The piston cooling device may be provided with an air feeder (for example, an air injection valve, or a Venturi to which compressed air is fed) for feeding air to the oil passage 93 of the oil jet 90. In this case, a range of the injection speed (or the injection flow rate) in which the plug flow can be formed in the cooling passage C can be extended.

The circumferential passage may be a passage which does not branch off in an inlet passage and an outlet passage.

Although the increasing rate is constant through the introduction passage in the above embodiments, the increasing rate may continuously increase from the most upstream portion of the introduction passage toward the most downstream portion.

Other apparatus (for example, a vessel propulsion unit such as an outboard engine, or a generator) than a vehicle may be provided with the internal combustion engine.

EXPLANATION OF REFERENCES

20: piston
30: inlet passage
40: outlet passage
51, 52: circumferential passage
61, 62 introduction passage
71, 72: main passage
81, 82: delivery passage
90: oil jet
92: orifice
93: oil passage
94: injection port
96: oil pump
97: main gallery
E: internal combustion engine
C: cooling passage

The invention claimed is:

1. A piston cooling device, comprising:

a piston for an internal combustion engine in which a cooling passage is provided, the cooling passage having a circumferential passage extending in a circumferential direction, and an inlet passage and an outlet passage communicating with the circumferential passage respectively, wherein the circumferential passage comprises introduction passages communicated with the inlet passage at most upstream portions; and main passages communicated with the introduction passages at most upstream portions, and the introduction passages are diffuser passages which extend upward and bend in circumferential directions so as to be communicated with the main passages, and cross-sectional areas thereof continuously increase toward the downstream; and an oil jet which injects an oil from an injection port placed below the inlet passage opening downward when the piston reciprocates in an up-and-down direction, the oil injected from the injection port flows into the inlet passage and flows out of the outlet passage through the circumferential passage, wherein the oil jet injects the oil at every stroke of the piston and an injection speed of the oil at the injection port is equal to or less than a maximum speed of the piston when the internal combustion engine is operated at a maximum output operation such that a gas-liquid two-phase plug flow composed of a gas and the oil is formed in the cooling passage at least when the internal combustion engine is operated at the maximum output, and wherein an increasing rate R which is defined by the following equation $$R=d(A^{1/2})/dS$$

is equal to or greater than 0.06 and is equal to or less than 0.8, where S (m) is a distance from the most upstream portions on a passage center line of the introduction passages, and A ($m^2$) is a cross-sectional area of the introduction passages on a plane orthogonal to the passage center line.

2. The piston cooling device of claim 1, wherein the introduction passages comprise first and second branch introduction passages which branch off in opposite circumferential directions to each other at a branch portion, the main passages comprise first and second main passages communicated with the first and second branch introduction passages respectively, and the branch portion is placed closer to a piston top face than to the lowermost portions of the first and second main passages in the up-and-down direction.

3. The piston cooling device of claim 2, wherein the branch portion is placed on a passage center line Li of the inlet passage.

4. The piston cooling device of claim 2, wherein passage cross-sections and the positions of the most upstream portions of the first and second branch introduction passages are the same as those of a most downstream portion of the inlet passage.

5. The piston cooling device of claim 1, wherein oil is discharged from an oil pump and is led to the oil jet via an oil supplying passage, the oil jet is provided with an injected oil passage having the injection port, the oil is decompressed by an orifice and is led from the oil supplying passage to the injected oil passage, and an opening area of the injection port is greater than a throttle cross-sectional area of the orifice.

* * * * *